US009796197B2

(12) United States Patent
Takakusa

(10) Patent No.: US 9,796,197 B2
(45) Date of Patent: Oct. 24, 2017

(54) INKJET PRINTING MACHINE

(71) Applicant: RISO KAGAKU CORPORATION, Tokyo (JP)

(72) Inventor: Tadashi Takakusa, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 15/361,616

(22) Filed: Nov. 28, 2016

(65) Prior Publication Data

US 2017/0151817 A1 Jun. 1, 2017

(30) Foreign Application Priority Data

Nov. 30, 2015 (JP) ..... 2015-232923

(51) Int. Cl.
*B41J 25/00* (2006.01)
*B41J 2/01* (2006.01)

(52) U.S. Cl.
CPC ..... *B41J 25/006* (2013.01); *B41J 2/01* (2013.01)

(58) Field of Classification Search
CPC ..... B41J 25/006; B41J 2/01
See application file for complete search history.

(56) References Cited

U.S. PATENT DOCUMENTS 7,001,016 B2 * 2/2006 Baxter ..... B41J 3/4073 347/101
8,764,183 B2 * 7/2014 Schaeffer ..... B41J 3/28 347/101
2005/0270317 A1 12/2005 Gao et al.

FOREIGN PATENT DOCUMENTS

JP 2005-262581 9/2005

* cited by examiner

*Primary Examiner* — Lamson Nguyen
(74) *Attorney, Agent, or Firm* — Greenblum & Bernstein, P.L.C.

(57) ABSTRACT

The inkjet printing machine includes a controlling unit, an inkjet head including a plurality of nozzles, and a head elevating motor that causes the inkjet head to move up or down. The controlling unit causes, while the inkjet head is being moved in a main-scanning direction, the head elevating motor to move the inkjet head up or down depending on unevenness of a surface of a printing medium, selects a nozzle from the nozzles depending on a distance between the inkjet head and the surface of the printing medium at a position of each of the nozzles, and performs printing by using the selected nozzle.

2 Claims, 12 Drawing Sheets

INKJET PRINTING MACHINE

CROSS REFERENCE TO RELATED APPLICATION

This application claims benefit of priority under 35 U.S.C. §119 to Japanese Patent Application No. 2015-232923, filed on Nov. 30, 2015, the entire contents of which are incorporated by reference herein.

BACKGROUND OF THE INVENTION

1. Field of the Invention

The present invention relates to an inkjet printing machine that discharges an ink from an inkjet head to perform printing.

2. Description of the Related Art

An inkjet printing machine that discharges an ink drop on a printing medium from a nozzle while moving the inkjet head including a plurality of the nozzles is known in the art (See, for example, Japanese Patent Application Laid-Open No. 2005-262581).

Such an inkjet printing machine is sometimes used to perform printing on a printing medium having an uneven surface. If the height of the inkjet head from the printing medium having the uneven surface is kept constant, a distance (a head gap) between the inkjet head and the surface of the printing medium varies depending on the position of the inkjet head with respect to the printing medium. Such a variation in the head gap causes a landing misalignment of the ink drop. Therefore, if printing is performed by discharging an ink from a constant-height inkjet head on a printing medium having an uneven surface, there is a possibility of occurrence of degradation in the printing quality due to a landing misalignment of the ink drop.

If the height of the inkjet head can be adjusted depending on the uneveness of the surface of the printing medium, the variation in the head gap can be reduced. Accordingly, degradation in the printing quality due to the landing misalignment of the ink drop can be reduced.

However, even if the height of the inkjet head is adjusted, the head gap may be different for each of the nozzles depending on the state of the unevenness of the surface of the printing medium. Therefore, the head gap can go out of an appropriate range thereof for some of the nozzles, which causes occurrence of the landing misalignment of the discharged ink drop. As a result, the printing quality may degrade.

SUMMARY OF THE INVENTION

The present invention is made in view of the above discussion. One object of the present invention is to provide an inkjet printing machine that can reduce degradation of the printing quality.

According to one aspect of the present invention, there is provided an inkjet printing machine including an inkjet head that includes a plurality of nozzles arranged along a sub-scanning direction; a main-scanning driver that moves the inkjet head. in a main-scanning direction that is orthogonal to the sub-scanning direction; a sub-scanning driver that relatively moves the inkjet head and a printing medium in the sub-scanning direction; an elevator driver that moves the inkjet head up or down; and a controller that controls to perform printing an image on the printing medium by alternately repeating an operation of discharging an ink drop on the printing medium from a nozzle selected from the nozzles while causing the main-scanning driver to move the inkjet head in the main-scanning direction, and an operation of causing the sub-scanning driver to relatively move the inkjet head and the printing medium in the sub-scanning direction, wherein the controller causes, while the inkjet head is being moved in the main-scanning direction, the elevator driver to move the inkjet head up or down depending on unevenness of a surface of the printing medium, selects a nozzle from the nozzles depending on a distance between the inkjet head and the surface of the printing medium at a position of each of the nozzles, and performs the printing by using the selected nozzle.

According to another aspect of the present invention, the controller selects the nozzle depending on an ink discharge speed of each of the nozzles in addition to the distance.

According to the above aspect of the present invention, the controller causes, while the inkjet head is being moved in the main-scanning direction, the elevator driver to move the inkjet head up or down depending on unevenness of a surface of the printing medium. In addition, the controller selects a nozzle from the nozzles depending on a distance between the inkjet head and the surface of the printing medium at a position of each of the nozzles, and performs the printing by using the selected nozzle. As a result, the landing misalignment of the ink drop arising from the difference in the distance between the inkjet head and the surface of the printing medium per position of each of the nozzles can be reduced. As a result, degradation of the printing quality can be reduced.

According to the above aspect of the present invention, because the controller selects the nozzle depending on an ink discharge speed of each of the nozzles in addition to the distance, the landing misalignment of the ink drop can be reduced further. As a result, degradation of the printing quality can be reduced further.

DESCRIPTION OF THE EMBODIMENTS

Figure 1:
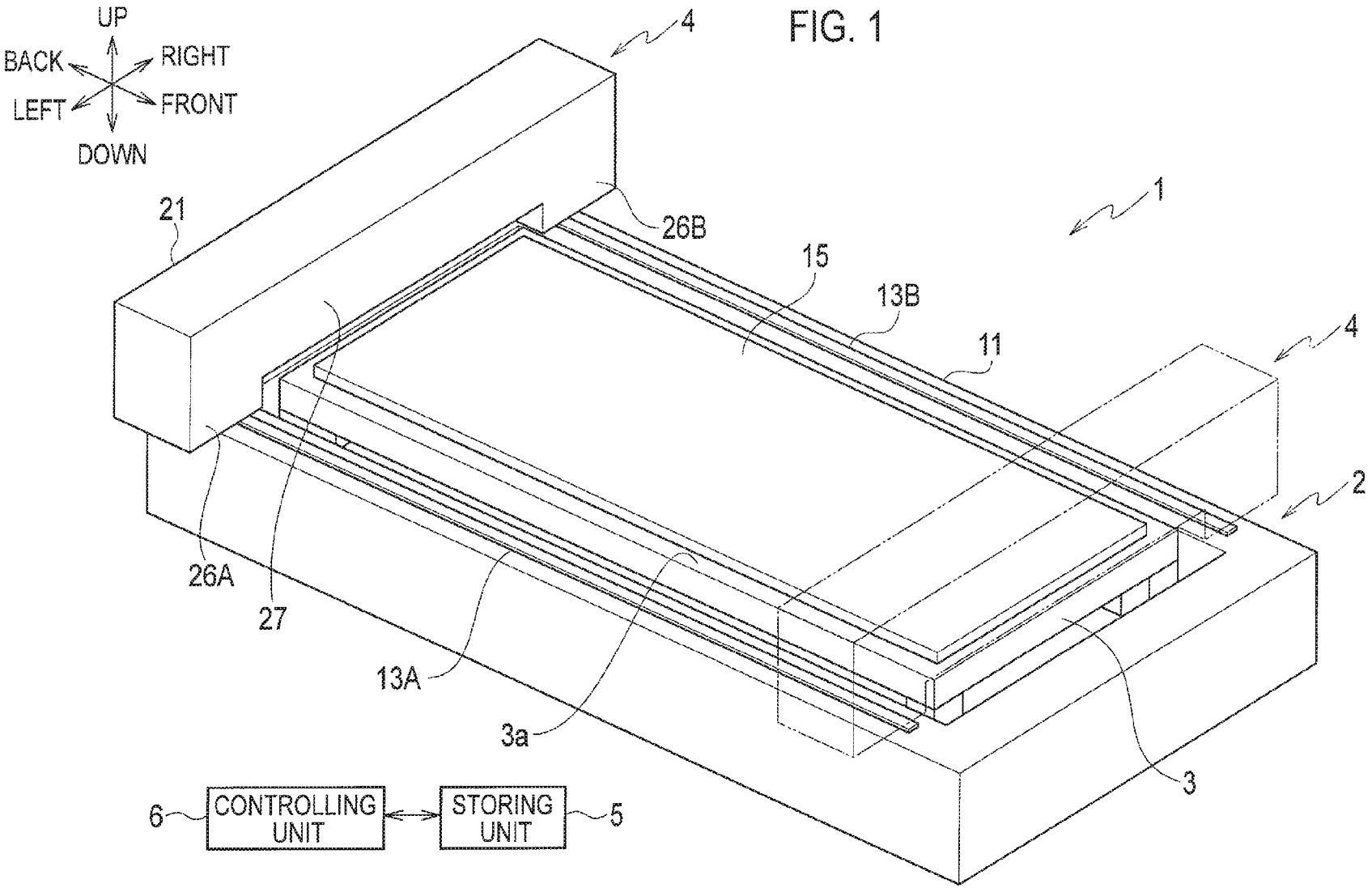
FIG. 1 is a schematic perspective view of a configuration of an inkjet printing machine according to an embodiment of the present invention.

Exemplary embodiments of the present invention will be described below with reference to the accompanying drawings. In the drawings, the same or similar reference symbol is attached to the same or similar structural element.

The following embodiments present examples of an apparatus and the like for realizing the technical concept of the present invention. The technical concept of the present invention regarding the material, the shape, the structure, the arrangement, and the like of various structural components is not limited to these embodiments. Various modifications can be made in the technical concept of the present invention within the scope of claims.

Figure 2:
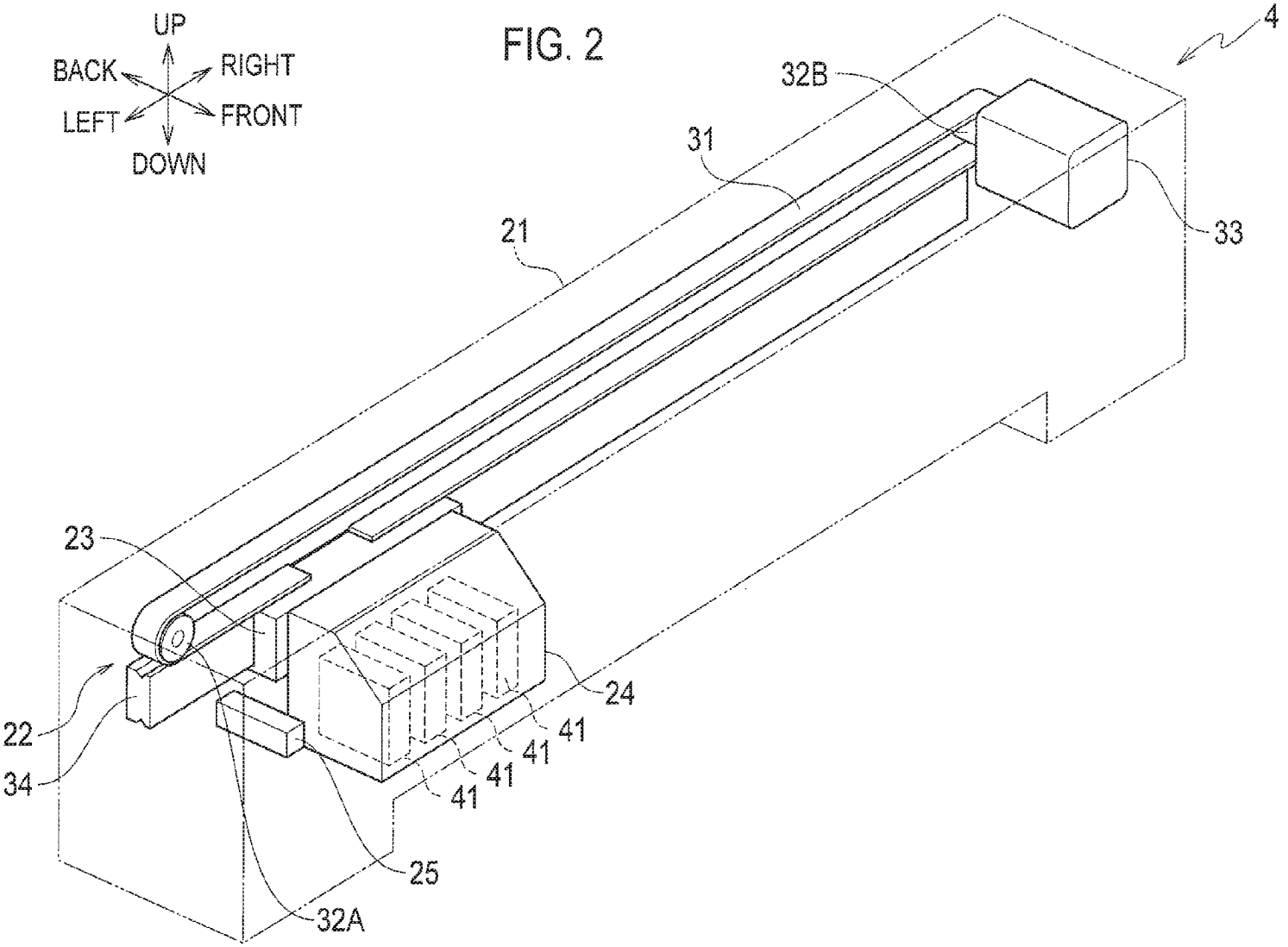
FIG. 2 is a perspective view of major parts of a shuttle unit of the inkjet printing machine shown in FIG. 1.
Figure 3:
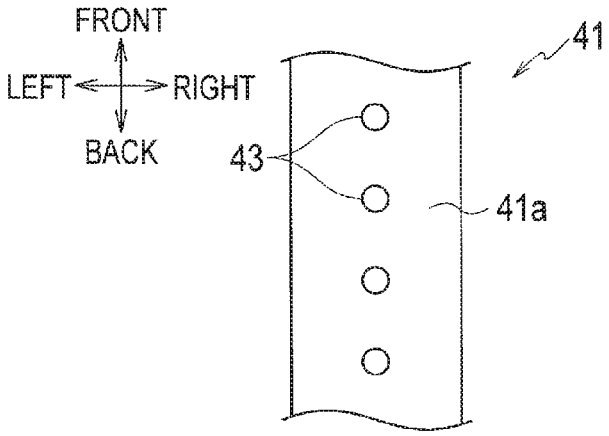
FIG. 3 is a schematic view of a nozzle face of an inkjet head of the inkjet printing machine shown in FIG. 1.
Figure 4:
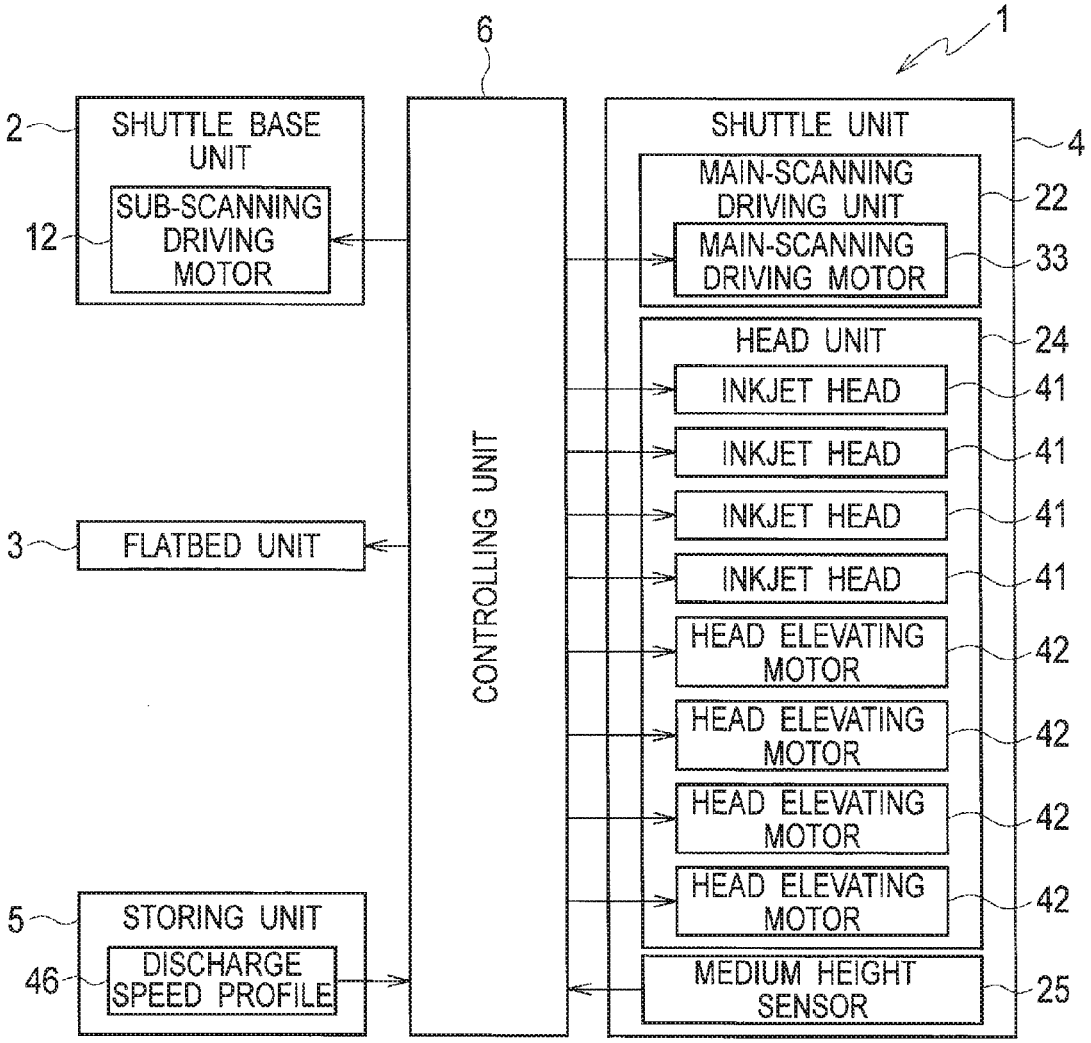
FIG. 4 is a control block diagram of the inkjet printing machine shown in FIG. 1.

FIG. 1 is a schematic perspective view of a configuration of an inkjet printing machine according to an embodiment of the present invention. FIG. 2 is a perspective view of major parts of a shuttle unit of the inkjet printing machine shown in FIG. 1. FIG. 3 is a schematic view of a nozzle face of an inkjet head of the inkjet printing machine shown in FIG. 1. FIG. 4 is a control block diagram of the inkjet printing machine shown in FIG. 1. In the following explanation, top and bottom, right and left, front and back shown with arrows in FIG. 1 define a vertical direction, a right-left direction, and a front-back direction, respectively.

As shown in FIGS. 1 and 4, an inkjet printing machine 1 includes a shuttle base unit 2, a flatbed unit 3, a shuttle unit 4, a storing unit 5, and a controlling unit 6.

The shuttle base unit 2 supports the shuttle unit 4 and moves the shuttle unit 4 in the front-back direction (sub-scanning direction). The shuttle base unit 2 includes a stand 11 and a sub-scanning driving motor 12.

The stand 11 supports the shuttle unit 4. The stand 11 has a shape of a rectangular frame. Sub-scanning drive guides 13A and 13B that extend in the front-back direction are arranged on a left and a right frames of the stand 11, respectively. The sub-scanning drive guides 13A and 13B guide the shuttle unit 4 that moves in the front-back direction.

The sub-scanning driving motor 12 moves the shuttle unit 4 in the front-back direction.

The flatbed unit 3 supports a printing medium 15 constituted by a building material and the like. The flatbed unit 3 is arranged inside the stand 11 (a space surrounded by the frame thereof) of the shuttle base unit 2. The flatbed unit 3 has a medium placement surface 3*a* that is a horizontal surface for placing the printing medium 15. The height of the medium placement surface 3*a* of the flatbed unit 3 can be adjusted by using an elevator mechanism (not shown) constituted by a hydraulic driving mechanism and the like.

The shuttle unit 4 prints an image on the printing medium 15. As shown in FIGS. 1, 2, and 4, the shuttle unit 4 includes a housing 21, a main-scanning driving unit 22, a main-scanning movable table 23, a head unit 24, and a medium height sensor 25.

The housing 21 houses all the parts such as the head unit 24. The housing 21 is formed in the form of a gate that arches over the flatbed unit 3 in the right-left direction. The housing 21 has a left leg member 26A and a right leg member 26B that are supported by the stand 11 of the shuttle base unit 2, and the housing 21 is movable along the sub-scanning drive guides 13A and 13B. The housing 21 includes a horizontal member 27 between the leg members 26A and 263. A bottom side of the horizontal member 27 has an opening for discharging an ink from the head unit 24 to the printing medium 15.

The main-scanning driving unit 22 moves the main-scanning movable table 23 in the right-left direction to move the head unit 24 in the right-left direction (main-scanning direction). The main-scanning driving unit 22 includes a driving belt 31, a pair of pulleys 32A and 32B, a main-scanning driving motor 33, and a main-scanning drive guide 34.

The driving belt 31 moves the main-scanning movable table 23 by making a circular movement. The driving belt 31 is stretched over the pulleys 32A and 32B.

The pulleys 32A and 32B support the driving belt 31 and cause the driving belt 31 to make the circular movement. The pulleys 32A and 32B are rotatably supported by a back-side wall of the housing 21. The pulleys 32A and 32B are separated in the right-left direction and are arranged at the same height. The pulley 32B is connected to an output shaft of the main-scanning driving motor 33 and transmits a rotary driving force of the main-scanning driving motor 33 to the driving belt 31.

The main-scanning driving motor 33 causes the driving belt 31 to make the circular movement by rotating the pulley 32B.

The main-scanning drive guide 34 guides the main-scanning movable table 23 to move along the right-left direction. The main-scanning drive guide 34 is an elongated member and extends in the right-left direction. The main-scanning drive guide 34 is mounted on the back-side wall of the housing 21.

The main-scanning movable table 23 is a table on which the head unit 24 is placed. The main-scanning movable table 23 is fixed to the driving belt 31. The main-scanning movable table 23 moves along the main--scanning drive guide 34 in the right--left direction by the circular movement of the driving belt 31.

The head unit 24 discharges the ink while moving in the right-left direction, thereby printing the image on the printing medium 15. The head unit 24 is mounted on the main-scanning movable table 23. The head unit 24 moves in the right-left direction along with the main-scanning movable table 23. The head unit 24 includes four inkjet heads 41 and four head elevating motors 42.

The four inkjet heads 41 are arranged side-by-side in the right-left direction. Each of the inkjet heads 41 includes a plurality of nozzles 43 arranged at a predetermined pitch in the front-back direction. These nozzles 43 open on a nozzle surface 41*a* that is a lower surface of the inkjet head 41. The ink drops are discharged on the printing medium 15 from the nozzles 43. Each of the four inkjet heads 41 discharges an ink of a different color (for example, cyan, black, magenta, and yellow).

Each of the four head elevating motors 42 causes an up-down movement of a corresponding one of the inkjet heads 41.

The medium height sensor 25 has a measurement width equal to or larger than a printing width of the inkjet head 41. The medium height sensor 25 measures a surface height of the printing medium 15 at each of several measurement locations within the measurement width. The printing width of the inkjet head 41 is a width of the area in the front-back direction within which the inkjet head 41 can perform the printing in one scan in the main-scanning direction. The medium height sensor 25 is fixed to the head unit 24 and moves in the right-left direction along with the head unit 24. A measurement widthwise direction of the medium height sensor 25 is parallel to the front-back direction. The medium height sensor 25 is arranged so that. when seen from the right-left direction, a front side thereof is positioned adjacent to a back side of the inkjet head 41. As a result, the medium height sensor 25 can measure a surface height of the printing medium 15 within a printable area in the next pass during a printing operation for the current pass. The medium height sensor 25 is constituted by, for example, laser-type displacement sensor.

The storing unit 5 stores therein a discharge speed profile 46. The discharge speed profile 46 is used in the high-resolution printing which will be described later. The discharge speed profile 46 is data about an ink discharge speed of each of the nozzles 43 of each of the inkjet heads 41. An ink discharge speed of each of the nozzles 43 of the same inkjet head 41 can be different due to manufacturing variation. The ink discharge speed of each of the nozzle 43 in the discharge speed profile 46 represents a value measured beforehand. The storing unit 5 is constituted by an HDD (Hard Disk Drive) and the like.

The controlling unit 6 controls the operation of all the parts of the inkjet printing machine 1. The controlling unit 6 includes CPU, RAM, ROM, and the like (not shown).

The controlling unit 6 causes the inkjet head 41 to discharge the ink on the printing medium 15 while moving the inkjet head 41 in the main-scanning direction, thereby performing the printing for one pass. Thereafter, the controlling unit 6 causes the shuttle unit 4 to move in the sub-scanning direction. The controlling unit 6 prints the image on the painting medium 15 by alternately repeating the printing operation for one pass and the movement of the shuttle unit 4.

The controlling unit 6 causes the inkjet head 41 to move up or down, by using the head elevating motor 42, depending on the unevenness of the surface of the printing medium 15 during the movement of the inkjet head 41 in the main-scanning direction for the printing operation for one pass. Along with this, the controlling unit 6 performs the printing by selecting the nozzles 43 depending on the head gap at the position of each of the nozzles 43. The head gap is the distance between the inkjet head 41 (the nozzle surface 41*a*) and the surface of the printing medium 15.

Subsequently, the operation of the inkjet printing machine 1 will be described.

Figure 5:
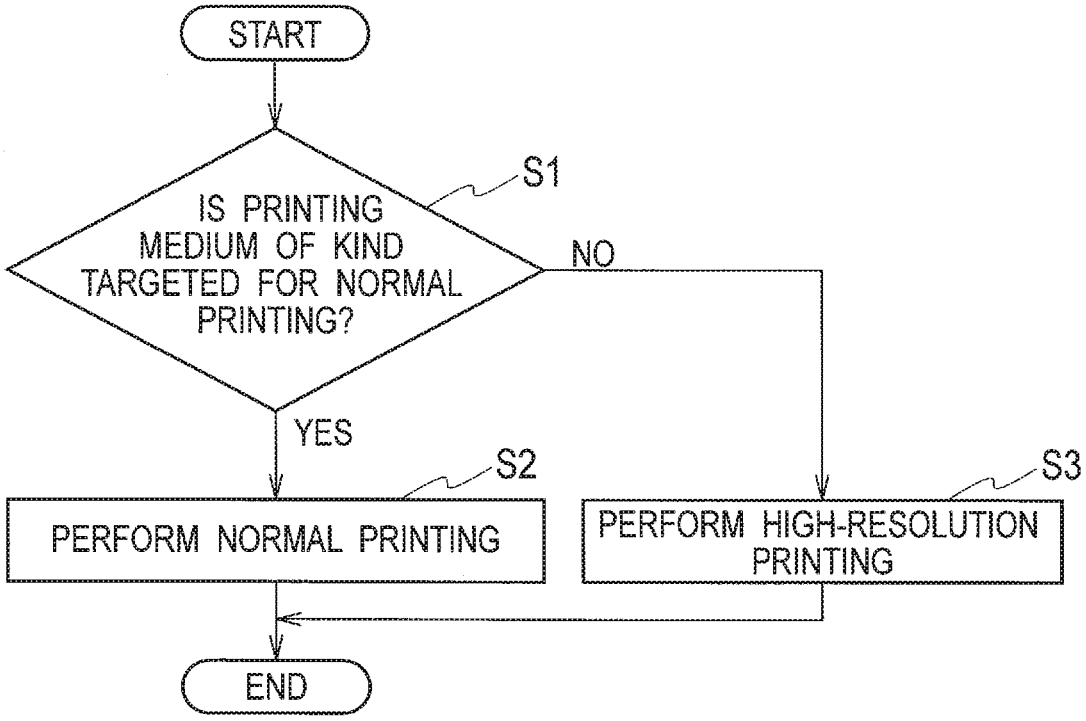
FIG. 5 is a flowchart for explaining an operation performed by the inkjet printing machine shown in FIG. 1.

FIG. 5 is a flowchart for explaining the operation of the inkjet printing machine 1. The processing shown in the flowchart of FIG. 5 is started when a print job is input into the inkjet printing machine 1 from an outside personal computer. Before starting the processing shown in the flowchart of FIG. 5, the printing medium 15 is set on the medium placement surface 3*a* of the flatbed unit 3.

At Step S1 of FIG. 5, the controlling unit 6 determines whether the kind of the printing medium 15 on which printing is to be performed this time is of a kind targeted for the normal printing. The controlling unit 6 determines the kind of the set printing medium 15 based on setting information included in the print job.

When it is determined that the kind of the set printing medium 15 is the kind targeted for the normal printing (Step S1: YES), at Step S2, the controlling unit 6 performs the normal printing which will be described later.

When it is determined that the kind of the set printing medium 15 is not the kind targeted for the normal printing (Step S1: NO) at Step S3, the controlling unit 6 performs the high-resolution printing which will be described later. The high-resolution printing is a printing process having reduced landing misalignment of the ink drop than the normal printing thereby presenting an improved image quality.

When the normal printing (Step S2) or the high-resolution printing (Step S3) is finished, the series of the operations is terminated.

Figure 6A:
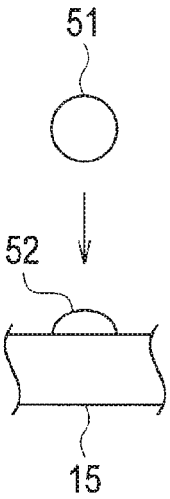
FIG. 6A is a view for explaining characteristics of a printing medium of a kind targeted for high-resolution printing.

The printing medium 15 of the kind targeted for the high-resolution printing, as shown in FIG. 6A, has a characteristic that, after an ink drop 51 lands thereon, the ink drop 51 does not spread but stays near the top surface of the printing medium 15 thereby forming a dot 52.

Figure 6B:
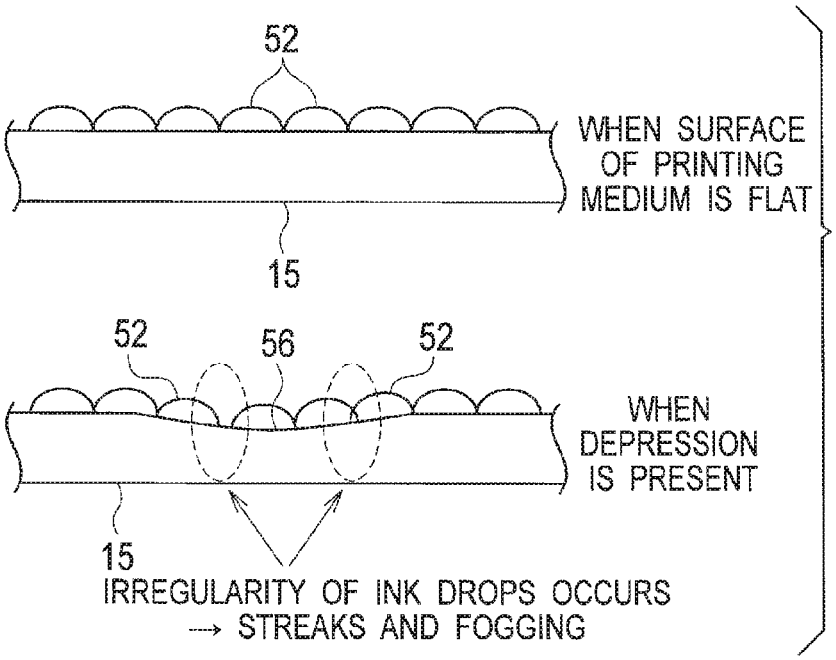
FIG. 6B is another view for explaining the characteristics of the printing medium of the kind targeted for the high-resolution printing.

In this type of the printing medium 15, as shown in the lower part of FIG. 6B, because of the presence of a depression 56 on the surface of the printing medium 15, if the landing misalignment of the ink drop occurs because the head gap here being different from in the neighborhood, irregularity of the ink drops occurs on the surface of the printing medium 15. Therefore, in comparison with an image printed on the printing medium 15 having no landing misalignment of the ink drop because the surface thereof is flat as shown in the upper part of FIG. 6B, degradation of the printing quality due to streaks and fogging becomes prominent. Therefore, for such type of the printing medium 15, the high-resolution printing having reduced landing misalignment of the ink drop than the normal printing is performed.

Figure 7A:
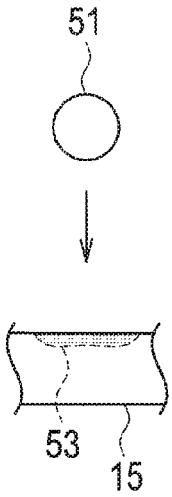
FIG. 7A is a view for explaining characteristics of a printing medium of a kind targeted for normal printing.

On the other hand, the printing medium 15 of the kind targeted for the normal printing, as shown in FIG. 7A, has a characteristic that, after the ink drop 51 lands thereon, the ink drop 51 enters the printing medium 15 thereby forming a wide dot 53.

Figure 7B:
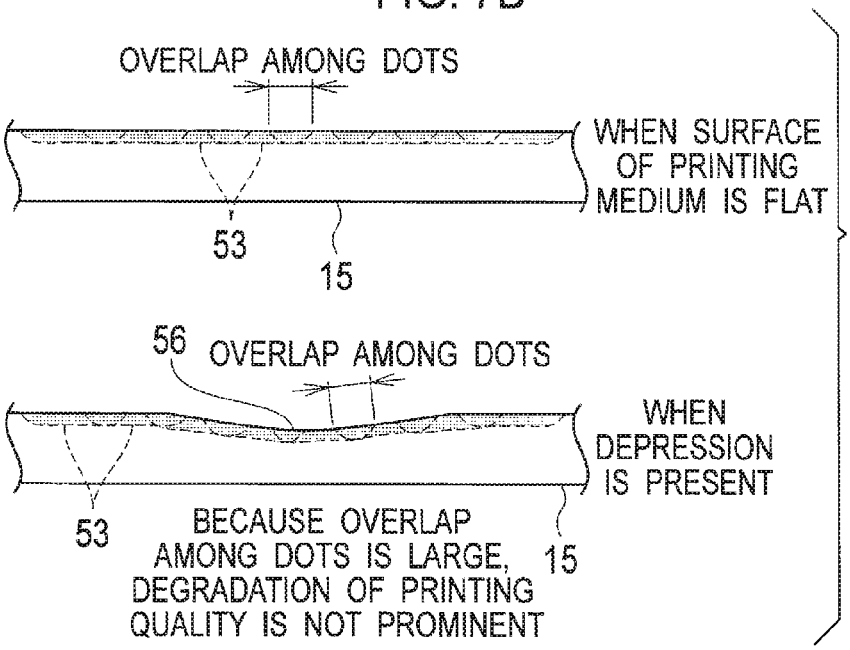
FIG. 7B is another view for explaining the characteristics of the printing medium of the kind targeted for the normal printing.

In this type of the printing medium 15, as shown in FIG. 7B, there is a large degree of overlap among the dots 53 in comparison with the printing medium 15 having the characteristic explained above by using FIGS. 6A and 6B. Therefore, when a printed image in which the landing misalignment of the ink drop has occurred because of the presence of the depression 56 in the printing medium 15 like in the lower part of FIG. 7B is compared with a printed image in which no landing misalignment of the ink drop has occurred because the surface of the printing medium 15 is flat like in the upper part of FIG. 7B, degradation of the printing quality of the former is not prominent. Therefore, for such type of the printing medium 15, the normal printing that is simpler than the high-resolution printing is performed.

Subsequently, the normal printing performed at Step S2 of FIG. 5 will be described.

At first, an outline of the normal printing will be described.

In the normal printing, during the movement of the inkjet head 41 in the main-scanning direction in the printing operation for one pass, the inkjet head 41 is moved up or down depending on the unevenness of the surface of the printing medium 15, and the printing is performed by using a nozzle 43 at a position at which the head gap is within the appropriate range.

Figure 8:
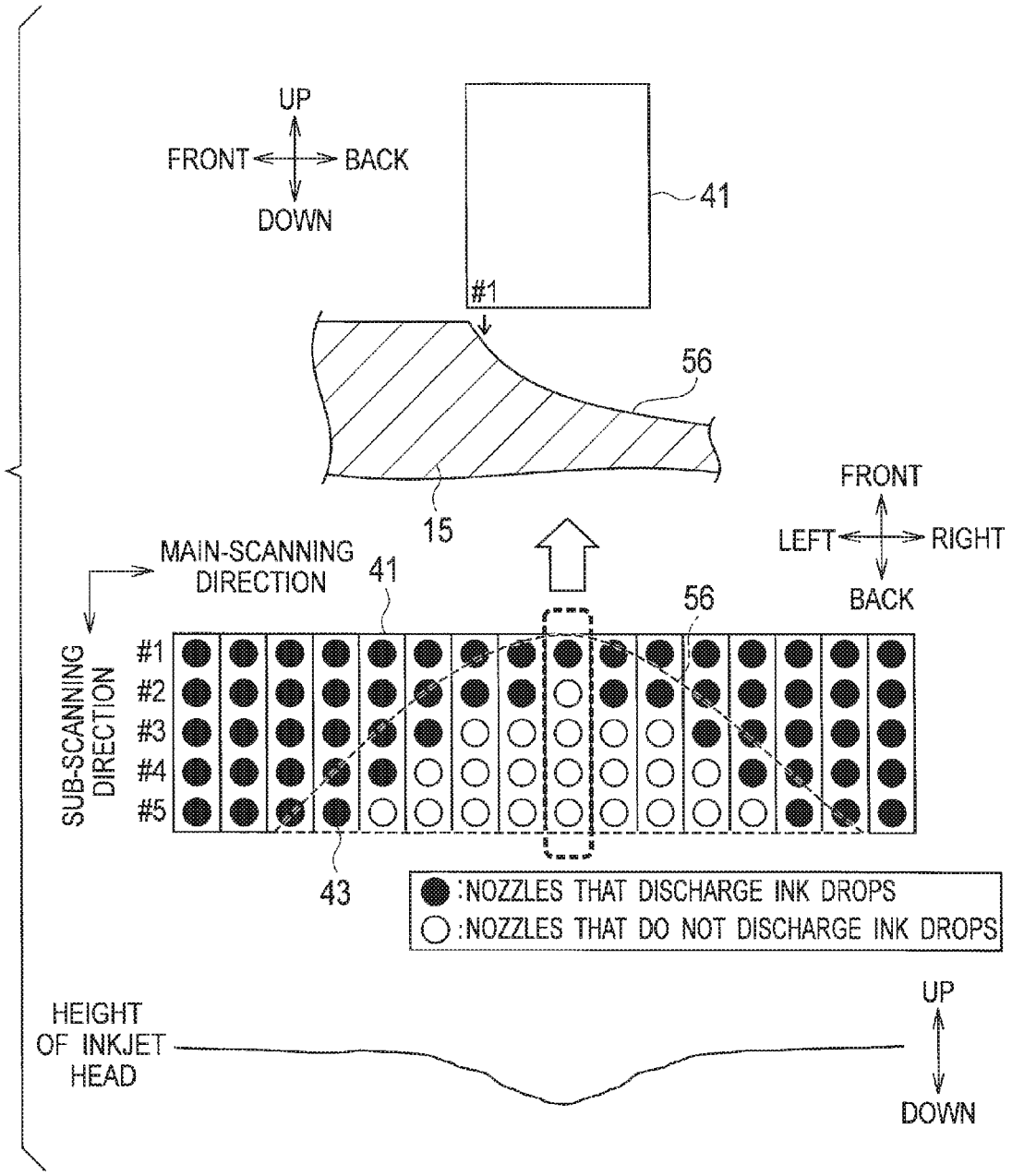
FIG. 8 is a view for explaining an outline of the normal printing.

For example, as shown in FIG. 8, the inkjet head 41 is lowered when it passes over the depression 56 of the printing medium 15. Moreover, the ink drops are discharged from those nozzles 43 that are at positions at which the head gap is within the appropriate range, but the ink drops are not discharged from those nozzles 43 that are at positions at which the head gap is out of the appropriate range. The appropriate range of the head gap is set beforehand as a range of the head gap in which the landing misalignment of the ink drop is within an allowable range.

In FIG. 8, to simplify the explanation, the number of the nozzles in one inkjet head 41 is assumed to be five. The five nozzles 43 are referred with nozzle numbers #1, #2, . . . , #5 from the front to back. Depending on the position of the inkjet head 41, the nozzles 43 that discharge the ink drops are shown with solid circles and the nozzles 43 that do not discharge the ink drops are shown with hollow circles.

Moreover, each of the pixels in the printable area of a pass shown in FIG. 8 is targeted for discharging the ink from the inkjet head 41. The nozzles 43 shown with the hollow circles are in fact required to discharge the ink drops to form the image; however, no ink drops are discharged therefrom because the head gap is out of the appropriate range.

For example, at the position of the inkjet head 41 surrounded with an extra-thick broken line, the bottom surface of the depression 56 deepens as one goes toward the back side. When the inkjet head 41 is at this position, at the positions of the second to the fifth (#2 to #5) nozzles 43, the head gap is too large and out of the appropriate range. Therefore, only the first nozzle 43 (#1) performs the ink drop discharge. To the pixels at the positions corresponding to the second to the fifth (#2 to #5) nozzles 43, the ink drops are discharged in the next pass or the passes thereafter.

Figure 9:
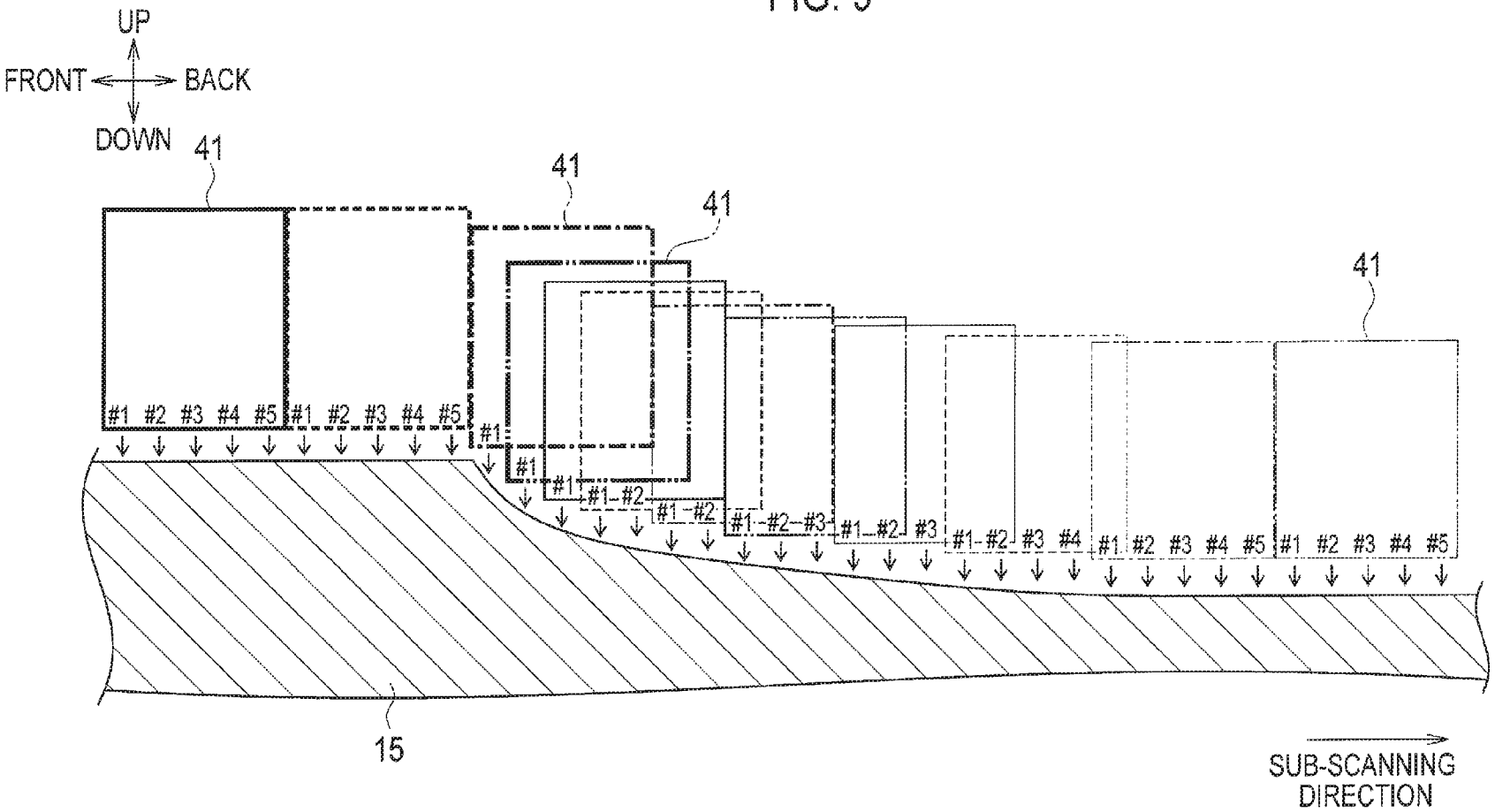
FIG. 9 is a view for explaining an example of nozzle selection in the normal printing.

In the normal printing, as shown in FIG. 9, the position in the sub-scanning direction of the inkjet head 41 to perform the printing operation of the current pass is determined depending on a use status of the nozzles 43 in the last pass.

FIG. 9 shows the nozzles 43 used in each pass to form a certain line along the sub-scanning direction in the image. The nozzle numbers (#1, #2, . . . ) shown inside the inkjet head 41 in FIG. 9 indicate nozzle numbers from which the ink drops are discharged.

For example, in FIG. 9, only the first nozzle 43 (#1) is used in the pass at the position (third from the front side) of the inkjet head 41 shown with an extra-thick alternate long-short dash line. Although it is necessary to discharge the ink drops from the other nozzles 43 to form the image, because the head gap thereof is out of the appropriate range, these nozzles 43 are not used. Therefore, the next pass is performed at the position of the inkjet head 41 shown with an extra-thick two-dot chain line that is toward the back side by one pitch of the nozzle 43.

In this pass, the height of the inkjet head 41 is adjusted, and the ink drop is discharged from the first nozzle 43 (#1) at the position that was the target of the discharge of the second nozzle 43 (#2) in the last pass. Because the head gap is out of the appropriate range at the positions of the other nozzles 43 even in this pass, these nozzles 43 are not used. Therefore, the next pass is performed at the position of the inkjet head 41 shown with a continuous line that is toward the back side by one pitch of the nozzle 43. After that, the similar operation is repeated.

In this manner, in the normal printing, in each of the passes, by adjusting the height of the inkjet head 41 and performing the printing by selectively using the nozzles 43 that are at the positions at which the head gap is within the appropriate range, the landing misalignment of the ink drop can be reduced.

Figure 10:
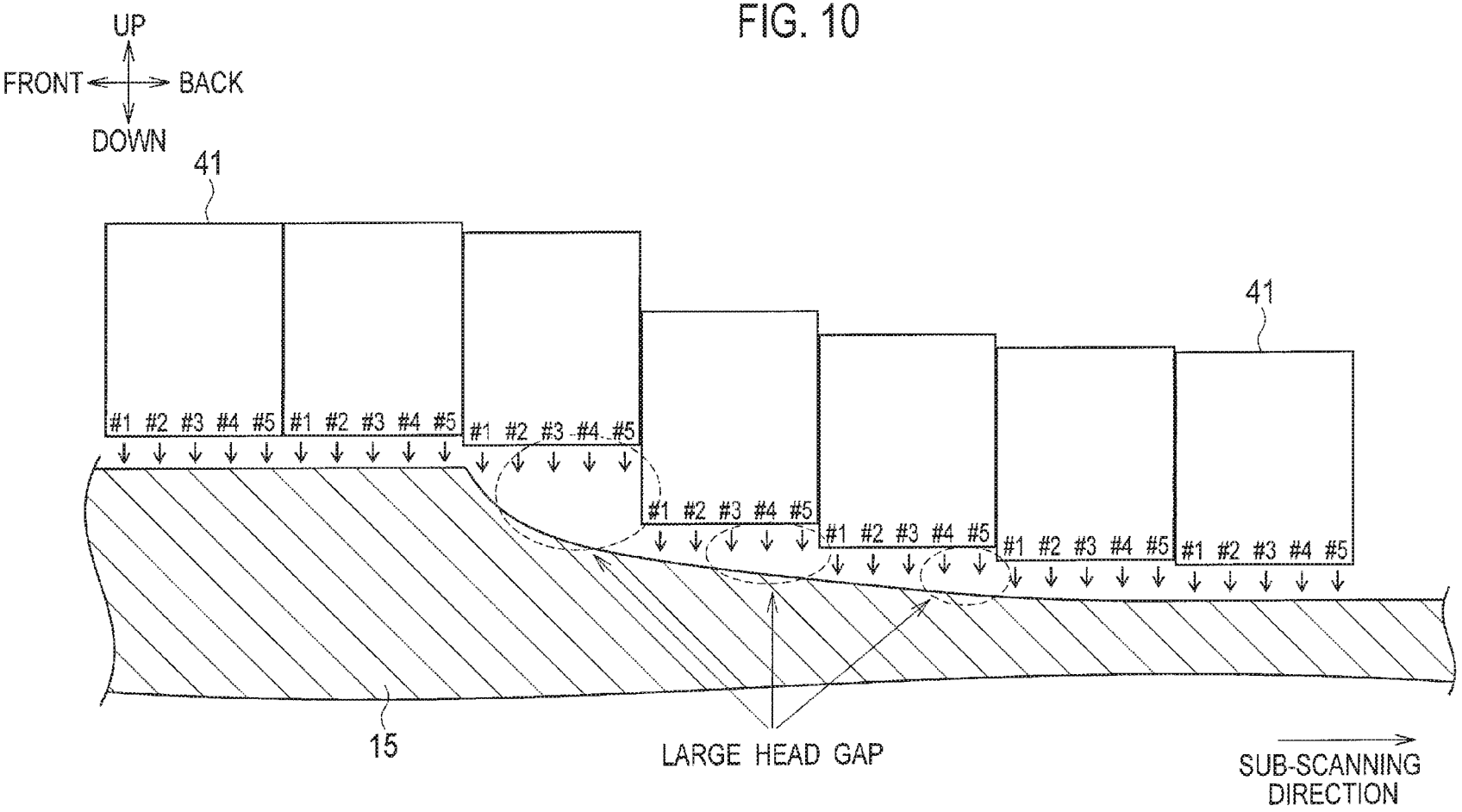
FIG. 10 is a view of a comparative example to FIG. 9.

In contrast, if the nozzles are not selected depending on the head gap, for example, as shown in FIG. 10, the ink drops are discharged also from the nozzles 43 that are at the positions at which the head gap is not within the appropriate range. Therefore, the printing quality may e degraded because of the occurrence of the landing misalignment of the ink drop.

Subsequently, a process procedure of the normal printing will be described with reference to a flowchart of FIG. 11.

Figure 11:
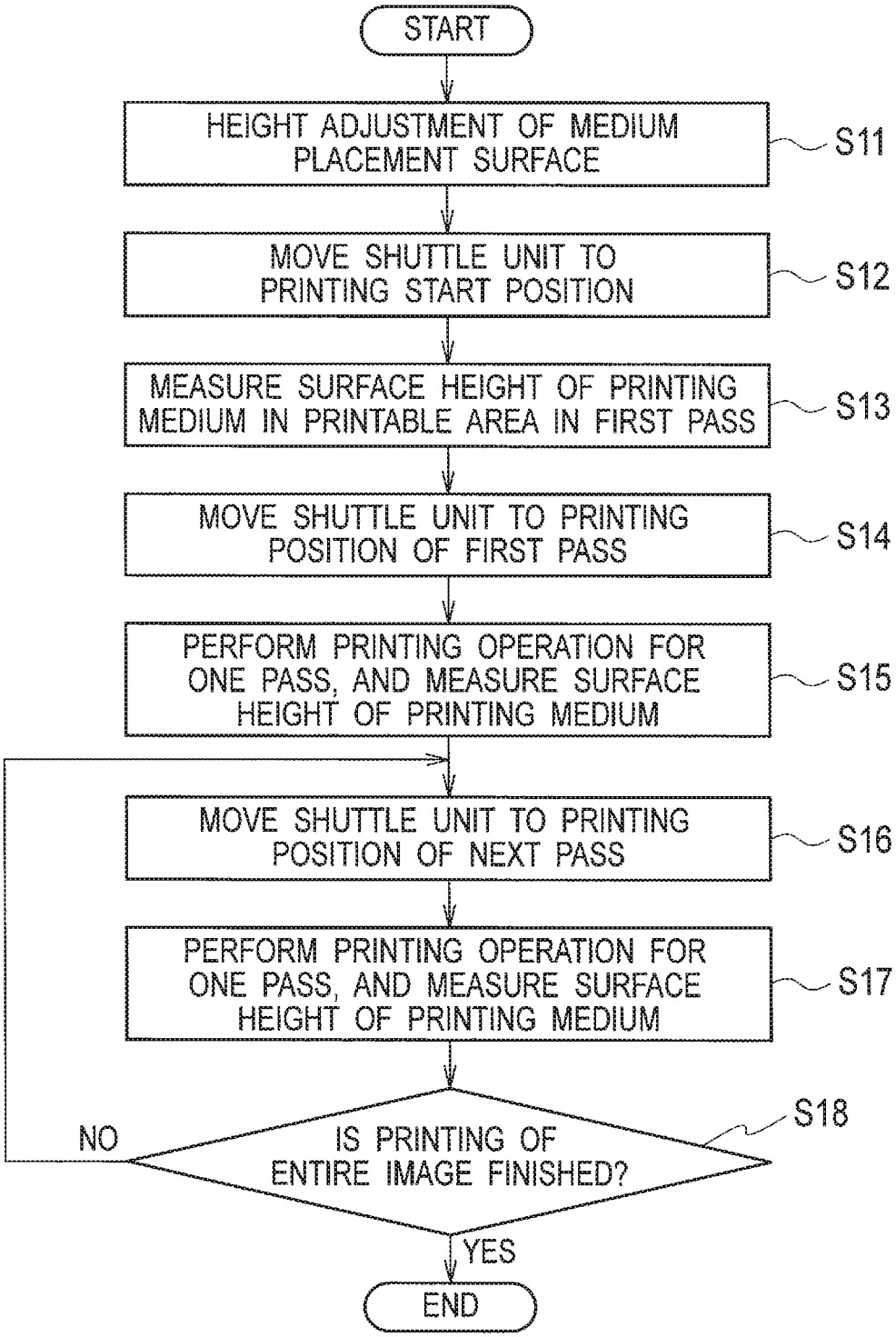
FIG. 11 is a flowchart of the normal printing.

At Step S11 of FIG. 11, the controlling unit 6 performs height adjustment of the medium placement surface 3*a*. Specifically, the controlling unit 6 controls the elevator mechanism of the flatbed unit 3 and adjusts the height of the medium placement surface 3*a* to adjust the head gap depending on the kind (thickness) of the printing medium 15.

Then, at Step S12, the controlling unit 6 controls the sub-scanning driving motor 12 to move the shuttle unit 4 from a standby position to a printing start position. The standby position of the shuttle unit 4 is the position of the shuttle unit 4 shown with a continuous line in FIG. 1 and it is at the back-side edge of the stand 11 of the shuttle base unit 2. The printing start position of the shuttle unit 4 is the position of the shuttle unit 4 shown with a two-dot chain line in FIG. 1 and it is at the front-side edge of the printing medium 15. The printing start position of the shuttle unit 4 is the position at which the medium height sensor 25 can scan the printable area by the inkjet head 41 in the first pass.

Then, at Step S13, the controlling unit 6 measures the surface height of the printing medium 15 in the printable area in the first pass. Specifically, the controlling unit 6 controls the main-scanning driving motor 33 to move the main-scanning movable table 23 in the main-scanning direction thereby scanning the printable area in the first pass with the medium height sensor 25. Then, the controlling unit 6 acquires measurement data from the medium height sensor 25.

Subsequently, at Step S14, the controlling unit 6 controls the sub-scanning driving motor 12 to move the shuttle unit 4 toward the back direction to a printing position of the first pass.

Subsequently, at Step S15, the controlling unit 6 performs the printing operation for one pass. Specifically, the controlling unit 6, while moving the head unit 24 in the main-scanning direction by controlling the main-scanning driving motor 33, causes the inkjet head 41 to discharge the ink based on the print job.

In the printing operation for one pass, the controlling unit 6 performs the height adjustment of the inkjet head 41, which needs to discharge the ink to at least one pixel of the extreme upstream (most front side) one line for forming the image based on the print job, depending on the unevenness of the surface of the printing medium 15 at the position of the extreme upstream one line. Specifically, the controlling unit 6 controls the height of the inkjet head 41, by using the head elevating motor 42, based on the measurement data acquired by the medium height sensor 25 at the position of the extreme upstream one line so that the head gap at the position of the extreme upstream nozzle 43 is maintained within the appropriate range. The controlling unit 6 controls the height of the other inkjet heads 41, by using the head elevating motor 42, based on the measurement data acquired by the medium height sensor 25 so that the head gap calculated from the highest point on the printing medium 15 that is right below the inkjet head 41 is maintained within the appropriate range.

Then, the controlling unit 6 causes those nozzles 43 to discharge the ink drops that are at the positions at which the head gap is within the appropriate range among the nozzles 43 that need to discharge the ink drops to form the image based on the print job.

As mentioned above, when the height of the inkjet head 41 that needs to discharge the ink to at least one pixel of the extreme upstream one line is adjusted depending on the unevenness of the surface of the printing medium 15 at the position of the extreme upstream one line, there is a possibility that the inkjet head 41 contacts the printing medium 15 depending on the unevenness of the surface of the printing medium 15 at other positions. In such a case, the controlling unit 6 adjusts the height of the inkjet head 41 regardless of the unevenness of the surface of the printing medium 15 at the position of the extreme upstream one line so that the inkjet head 41 does not contact the printing medium 15. In this case, the controlling unit 6 causes the extreme upstream nozzle 43 to discharge the ink drop even if the head gap at the position at which the extreme upstream nozzle 43 is to discharge the ink drop is out of the appropriate range.

Moreover, at Step S15, the controlling unit 6 causes the medium height sensor 25 to measure, simultaneously with performing the printing operation for the one pass, the surface height of the printing medium 15 in the area being scanned by the medium height sensor 25.

Subsequently, at Step S16, the controlling unit 6 controls the sub-scanning driving motor 12 to move the shuttle unit 4 toward the back direction to a printing position of the next pass. The printing position of the next pass is the position at which it is possible to discharge the ink drop from the extreme upstream nozzle 43 for the extreme upstream line among the lines on which a pixel on which the ink was not discharged by at least one of the inkjet heads 41 exists Subsequently, at Step S17, the controlling unit 6, simultaneously with performing the printing operation for one pass, measures the surface height of the printing medium 15 in the area being scanned by the medium height sensor 25. The processing at this Step S17 is similar to the processing at the above-described Step S15.

Subsequently, at Step S18, the controlling unit 6 determines whether printing of the entire image is finished. If the controlling unit determines that the printing of the entire image is not finished (Step S18: NO), the system control is returned to Step S16. If the controlling unit 6 determines that the printing of the entire image is finished (Step S18: YES), the normal printing is terminated.

Subsequently, the above-mentioned high-resolution printing performed at Step S3 of FIG. 5 will be described.

At first, an outline of the high-resolution printing will be described.

In the high-resolution printing, an ink discharge speed of each of the nozzles 43 is added to the selection criteria of the nozzles to be used.

Figure 12:
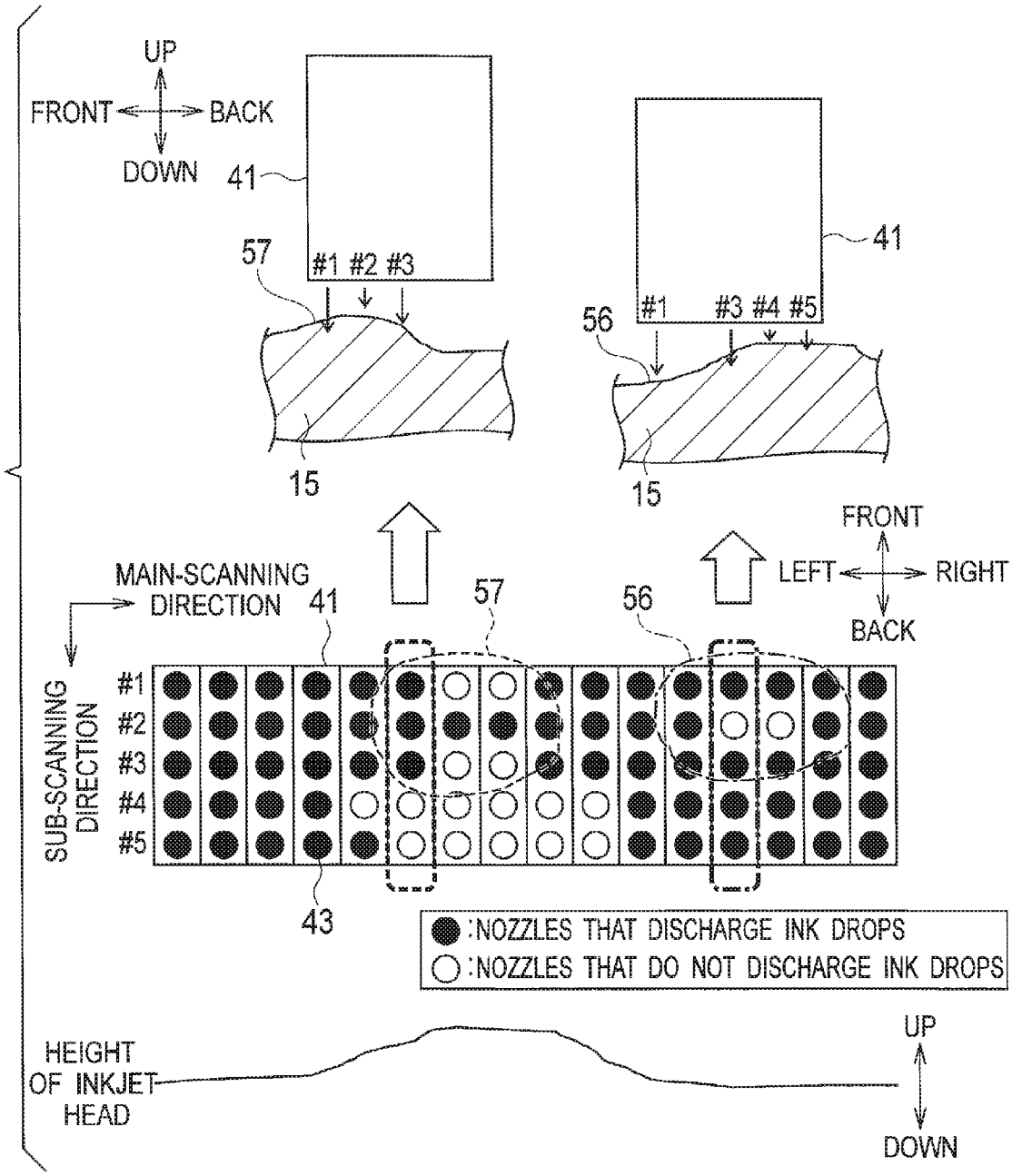
FIG. 12 is a view for explaining an outline of the high-resolution printing.

For example, as shown in FIG. 12, while causing the inkjet head 41 to go up or down, the ink drops are discharged from the first to the third nozzles 43 (#1 to #3) in a protrusion 57 at a position of the inkjet head 41 surrounded with an extra-thick broken line. At positions of the fourth and the fifth nozzles 43 (#4 and #5), because the head gap is too large for the ink discharge speeds of the fourth and the fifth nozzles 43, the ink drops are not discharged from the fourth and the fifth nozzles 43. In the upper part of FIG. 12, lengths of downward-pointing arrows shown below the nozzle numbers in the inkjet head 41 represent the ink discharge speeds of the corresponding nozzles 43.

At a position of the inkjet head 41 surrounded with an extra-thick alternate long-short dash line, the ink drops are discharged from the first and the third nozzles 43 (#1 and #3) in the depression 56. At a position of the second nozzle 43 (#2) because the head gap is too large for the ink discharge speed of the second nozzle 43, the ink drop is not discharged from the second nozzle 43. At positions of the fourth and the fifth nozzles 43 (#4 and #5), because the head gap is within the appropriate range for the ink discharge speeds of the fourth and the fifth nozzles 43, the ink drops are discharged from the fourth and the fifth nozzles 43.

Figure 13:
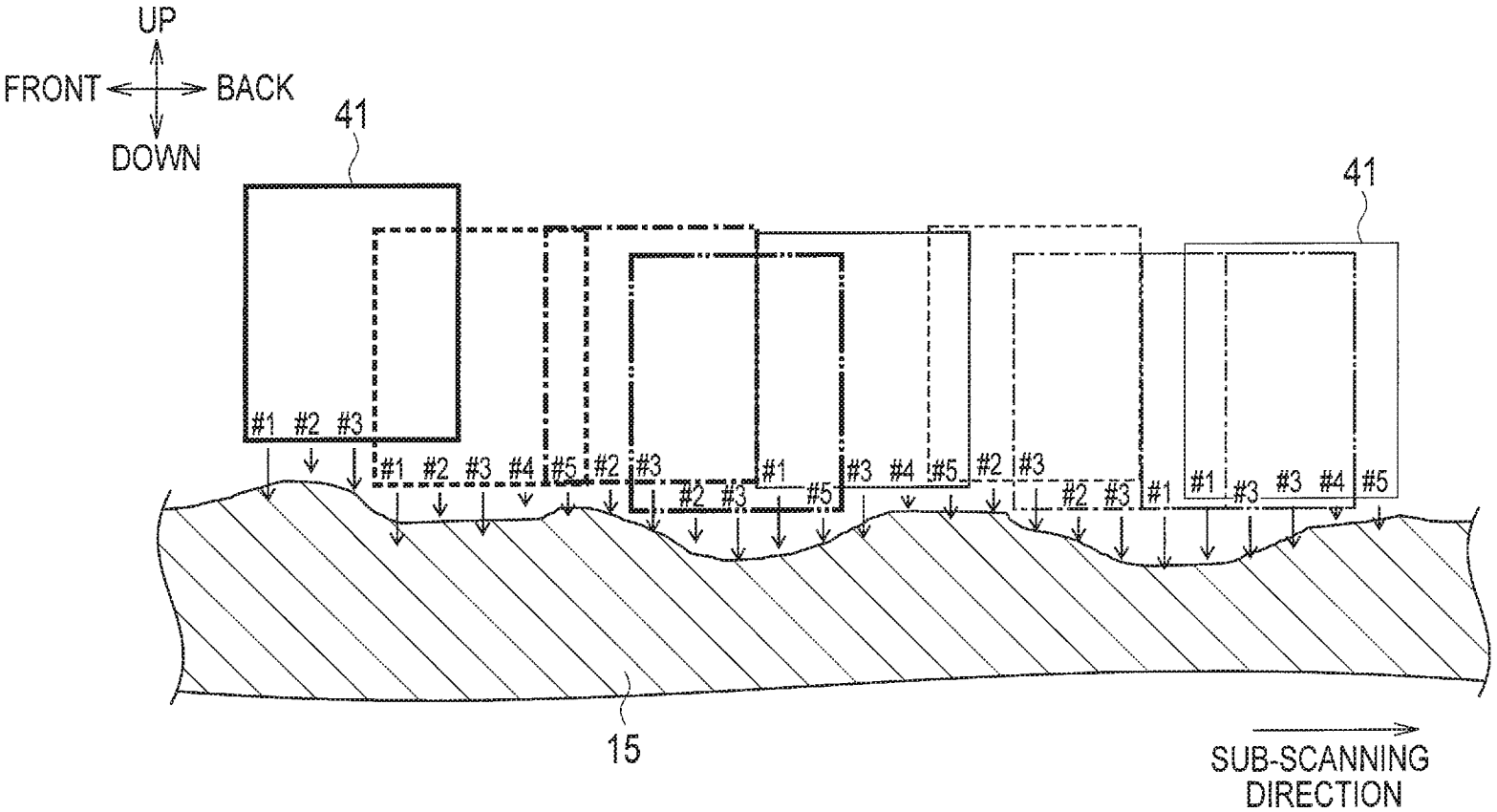
FIG. 13 is a view for explaining an example of nozzle selection in the high-resolution printing.

Even in case of the high-resolution printing, like in the normal printing, as shown in FIG. 13, the position in the sub-scanning direction of the inkjet head 41 to perform the printing operation in the current pass is determined based on a use status of the nozzles 43 in the last pass stored in the RAM and the like of the controlling unit 6. Then, in each of the passes, while adjusting the height of the inkjet head 41, the printing is performed by using the nozzles 43 that are at the positions at which the head gap is within the appropriate range corresponding to the ink discharge speed. As a result, the landing misalignment of the ink drop can be reduced than in the normal printing. Particularly, the present technique is useful when the unevenness is present in a small area on the surface of the printing medium 15.

Figure 14:
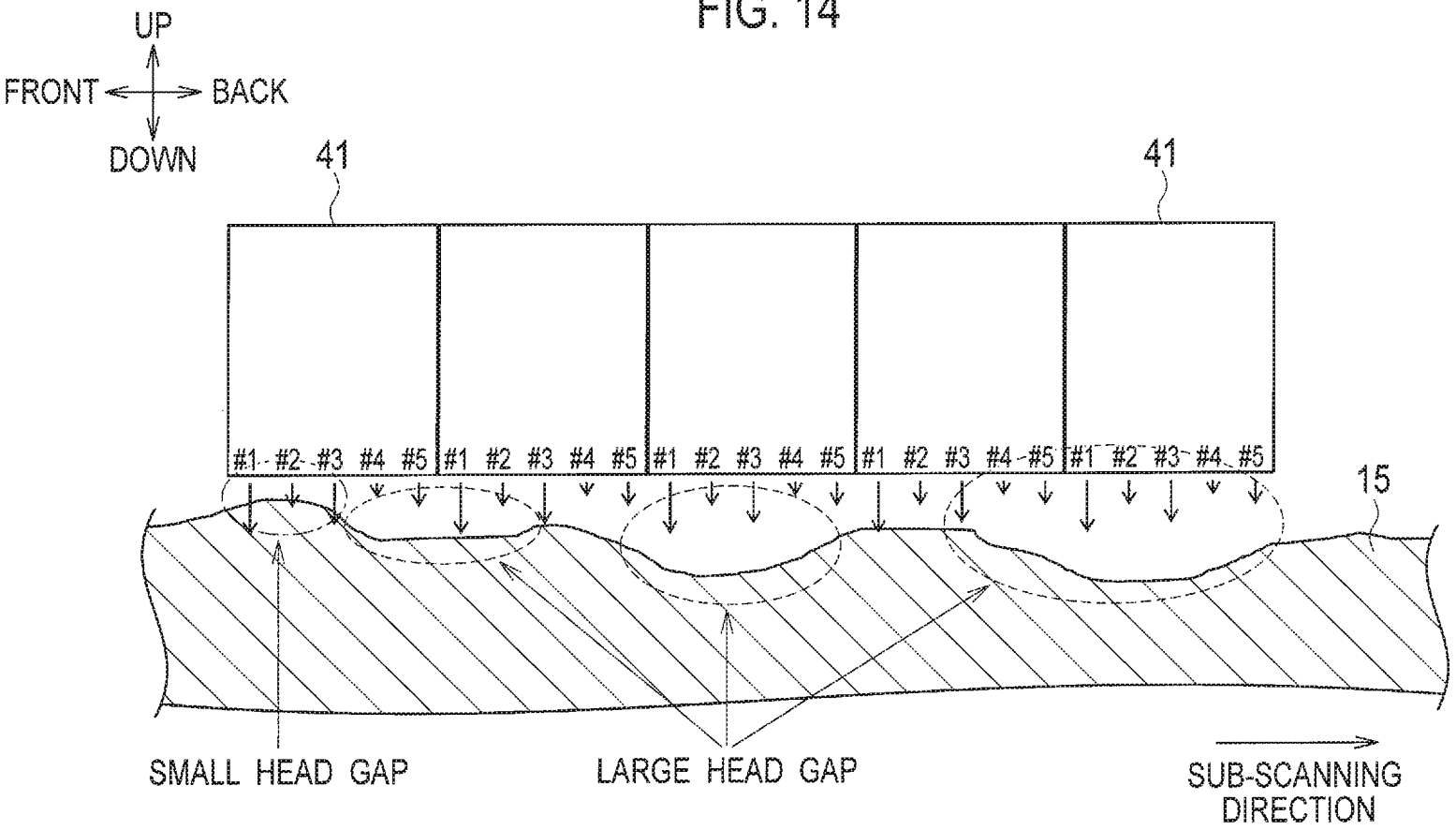
FIG. 14 is a view of a comparative example to FIG. 13.

In contrast, if the nozzles are not selected depending on the head gap and the ink discharge speed, as shown in FIG. 14, the ink drops are disadvantageously discharged from the nozzles 43 that are at the positions at which the head gap is out of the appropriate range corresponding to the ink discharge speed. Therefore, the printing quality may be degraded because of the occurrence of the landing misalignment of the ink drop.

Subsequently, a process procedure of the high-resolution printing will be described.

The process procedure of the high-resolution printing is similar to that of the normal printing explained with reference to the flowchart of FIG. 11 except that the contents of the printing operation for one pass are different.

In the high-resolution printing, in the printing operation for one pass, the controlling unit 6 adjusts the height of the inkjet head 41, which needs to discharge the ink to at least one pixel of the extreme upstream one line for forming the image based on the print job, depending on the unevenness of the surface of the printing medium 15 at the position of the extreme upstream one line and the ink discharge speed of the extreme upstream nozzle 43. Specifically, the controlling unit 6 controls the height of the inkjet head 41, by using the head elevating motor 42, based on the measurement data acquired by the medium height sensor 25 at the position of the extreme upstream one line and the discharge speed profile 46 so that the head gap at the position of the extreme upstream nozzle 43 is maintained within the appropriate range corresponding to the ink discharge speed of that nozzle 43.

The controlling unit 6 controls, similarly to the normal printing, the height of the other inkjet heads 41, by using the head elevating motor 42, based on the measurement data acquired by the medium height sensor 25 so that the head gap calculated from the highest point on the printing medium 15 that is right below the inkjet head 41 is maintained within the appropriate range.

Then, the controlling unit 6 causes, after referring to the discharge speed profile 46, those nozzles 43 to discharge the ink drops that are at the positions at which the head gap is within the appropriate range corresponding to the ink discharge speed of that nozzle 43 among the nozzles 43 that need to discharge the ink drops to form the image based on the print job.

As mentioned above, when the height of the inkjet head 41 that needs to discharge the ink to at least one pixel of the extreme upstream one line is adjusted depending on the unevenness of the surface of the printing medium 15 at the position of the extreme upstream one line and the ink discharge speed of the extreme upstream nozzle 43, there is a possibility that the inkjet head 41 contacts the printing medium 15 depending on the unevenness of the surface of the printing medium 15 at other positions. In such a case, the controlling unit 6 adjusts the height of the inkjet head 41 regardless of the unevenness of the surface of the printing medium 15 at the position of the extreme upstream one line so that the inkjet head 41 does not contact the printing medium 15. In this case, the controlling unit 6 causes the extreme upstream nozzle 43 to discharge the ink drop even if the head gap at the position at which the extreme upstream nozzle 43 is to discharge the ink drop is out of the appropriate range.

As described above, in the inkjet printing machine 1, the control ling unit 6 moves the inkjet head 41 up or down depending on the unevenness of the surface of the printing medium 15, and performs the printing by selectively using the nozzles 43 at the position at which the head gap of each of the nozzles 43 is within the appropriate range. Accordingly, the landing misalignment of the ink drop arising from the difference in the head gap at the position of each of the nozzles 43 can be reduced. As a result, degradation of the printing quality can be reduced.

Moreover, in the high-resolution printing, because the controlling unit 6 adds the ink discharge speed of each of the nozzles 43 to the selection criteria of the nozzle to be used, the landing misalignment of the ink drop can he reduced further. As a result, degradation of the printing quality can be reduced further.

The normal printing and the high-resolution printing can be performed together. Specifically, the high-resolution printing can be performed in a small area in which the unevenness is detected on the surface of the printing medium 15, and the normal printing can be performed in the remaining area.

Moreover, it is allowable to adopt a configuration in which one between the normal printing and the high-resolution printing is selected based on an instruction from a user via a printer driver.

Moreover, in the above embodiment, the printing medium 15 is fixed and the shuttle unit 4 is moved in the sub-scanning direction to perform the printing operation for one pass; however, it is allowable that the printing medium is moved in the sub-scanning direction to perform the printing operation for one pass. That is, it is allowable to adopt any configuration as long as the inkjet head and the printing medium are relatively moved in the sub-scanning direction that is orthogonal to the main-scanning direction to perform the printing operation for one pass.

Moreover, in the above embodiment, each of the inkjet heads 41 discharges the ink of different color; however, it is allowable that apart of the inkjet heads 41 discharges the ink of the same color.

Moreover, in the above embodiment, each of the inkjet heads 41 is separately moved up or down; however, it is allowable to move together all the inkjet heads 41 up or down. That is, the present invention is applicable to a configuration that causes the head unit 24 to move up or down. Even in this configuration, the head unit 24 (the inkjet head 41) is moved up or down depending on the unevenness of the surface of the printing medium, and the printing can be performed by selectively using the nozzles 43 depending on the head gap at the position of each of the nozzles 43 of each of the inkjet heads 41.

The present invention is not limited to the above embodiments and the structural components can be realized by modifying them without departing from the gist at the implementation stage. Moreover, various inventions can be constituted by appropriately combining the various structural components disclosed in the above embodiment. For example, some of the structural components among all the structural components described in the embodiments can be omitted.

What is claimed is:

1. An inkjet printing machine comprising:

an inkjet head that includes a plurality of nozzles arranged along a sub-scanning direction;

a main-scanning driver that moves the inkjet head in a main-scanning direction that is orthogonal to the sub-scanning direction;

a sub-scanning driver that relatively moves the inkjet head and a printing medium in the sub-scanning direction;

an elevator driver that moves the inkjet head up or down; and a controller that controls to perform printing an image on the printing medium by alternately repeating an operation of discharging an ink drop on the printing medium from a nozzle selected from the nozzles while causing the main-scanning driver to move the inkjet head in the main-scanning direction, and an operation of causing the sub-scanning driver to relatively move the inkjet head and the printing medium in the sub-scanning direction, wherein the controller causes, while the inkjet head is being moved in the main-scanning direction, the elevator driver to move the inkjet head up or down depending on unevenness of a surface of the printing medium, selects a nozzle from the nozzles depending on a distance between the inkjet head and the surface of the printing medium at a position of each of the nozzles, and performs the printing by using the selected nozzle.

2. The inkjet printing machine according to claim 1, wherein the controller selects the nozzle depending on an ink discharge speed of each of the nozzles in addition to the distance.

* * * * *